US010541467B1

(12) United States Patent
Brigham et al.

(10) Patent No.: US 10,541,467 B1
(45) Date of Patent: Jan. 21, 2020

(54) INTEGRATED COAXIAL NOTCH ANTENNA FEED

(71) Applicant: Massachusetts Institute Of Technology, Cambridge, MA (US)

(72) Inventors: Glenn A. Brigham, Chelmsford, MA (US); David M. Bragdon, Merrimack, NH (US); Edward M. Froehlich, Somerville, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 319 days.

(21) Appl. No.: 15/439,511

(22) Filed: Feb. 22, 2017

Related U.S. Application Data

(60) Provisional application No. 62/298,509, filed on Feb. 23, 2016.

(51) Int. Cl.

| | |
|---|---|
| ***H01Q 1/24*** | (2006.01) |
| ***H01Q 1/38*** | (2006.01) |
| ***H01Q 1/48*** | (2006.01) |
| ***H01Q 5/25*** | (2015.01) |
| ***H01Q 13/06*** | (2006.01) |
| ***H01Q 13/10*** | (2006.01) |
| ***H01Q 21/00*** | (2006.01) |

(52) U.S. Cl.
CPC ..... *H01Q 1/243* (2013.01); *H01Q 1/38* (2013.01); *H01Q 1/48* (2013.01); *H01Q 5/25* (2015.01); *H01Q 21/005* (2013.01)

(58) Field of Classification Search
CPC ..... H01Q 13/18; H01Q 13/10; H01Q 9/28; H01Q 21/064; H01Q 13/085; H01Q 13/065; H01Q 13/06; H01Q 21/005; H01Q 5/47
See application file for complete search history.

(56) References Cited

U.S. PATENT DOCUMENTS

| | | | | |
|---|---|---|---|---|
| 3,975,733 | A | 8/1976 | Bogner | |
| 5,973,653 | A | 10/1999 | Kragalott et al. | |
| 6,127,984 | A * | 10/2000 | Klebe | H01Q 13/08 343/767 |
| 6,891,511 | B1 | 5/2005 | Angelucci | |
| 8,350,767 | B2 | 1/2013 | Brigham et al. | |
| 8,736,504 | B1 | 5/2014 | West et al. | |

(Continued)

OTHER PUBLICATIONS

Office action dated Jun. 14, 2018 in co-pending U.S. Appl. No. 15/696,351.

(Continued)

*Primary Examiner* — Dameon E Levi
*Assistant Examiner* — Ricardo I Magallanes
(74) *Attorney, Agent, or Firm* — Nields, Lemack & Frame, LLC

(57) ABSTRACT

A novel system for supporting a plurality of notch antenna elements is disclosed. This system allows the creation of higher power ultra-wideband step notch arrays. The system also provides electrical connection to each of the notch antenna elements via respective coaxial cables or other direct connections. These coaxial cables connect to coaxial connectors disposed on a substrate that supports the notch antenna elements. Each coaxial connector is in electrical communication with one of the notch antenna elements. By replacing the printed circuit board traditionally used, higher power can be supplied to the notch antenna elements.

17 Claims, 7 Drawing Sheets

(56) References Cited

U.S. PATENT DOCUMENTS

| | | | | |
|---|---|---|---|---|
| 2002/0180655 | A1 | 12/2002 | Mohuchy et al. | |
| 2005/0007286 | A1 | 1/2005 | Trott et al. | |
| 2007/0241980 | A1* | 10/2007 | Smith | H01Q 9/28 343/773 |
| 2008/0211726 | A1 | 9/2008 | Elsallal et al. | |
| 2011/0057852 | A1 | 3/2011 | Holland et al. | |
| 2013/0176186 | A1 | 7/2013 | Yaccarino et al. | |
| 2013/0214980 | A1 | 8/2013 | Lambert et al. | |
| 2014/0218251 | A1 | 8/2014 | Waschenko et al. | |
| 2017/0194699 | A1* | 7/2017 | Ouedraogo | H01Q 1/36 |

OTHER PUBLICATIONS

International Search Report and Written Opinion dated May 23, 2018 in co-pending PCT application No. PCT/US2017/050165.
International Search Report and Written Opinion dated Nov. 9, 2017 in corresponding PCT application No. PCT/US17/18906.
Notice of allowance dated Sep. 26, 2018 in co-pending U.S. Appl. No. 15/696,351.

* cited by examiner

INTEGRATED COAXIAL NOTCH ANTENNA FEED

This application claims priority of U.S. Provisional Patent Application Ser. No. 62/298,509, filed Feb. 23, 2016, the disclosure of which is incorporated by reference in its entirety.

This invention was made with Government support under Contract No. FA8721-05-C-0002, awarded by the U.S. Air Force. The Government has certain rights in the invention.

FIELD

This disclosure relates to notch, tapered, and flared slot radiating antennas, and more particularly to an integrated coaxial notch antenna feed to allow increased power output.

BACKGROUND

Array antennas are used for a variety of different applications. Array antennas may be constructed using a plurality of notch antenna elements. The term "notch antenna" is intended to include tapered and flared elements, such that the shape is not limited by this disclosure. Each notch antenna element includes an electrically conductive body, referred to as a notch radiator element, which has a slot. The slot separates the notch radiator element into two prongs. One of the prongs may be grounded while the other prong is energized by an RF signal. In general, the energized prong conveys energy from a coaxial feed input into free space or air, or visa-versa. The coaxial transmission line has a characteristic impedance relative to the system impedance for maximum power transfer. The propagating signal leaving the coaxial transmission line, transitions to a tuned gap between the energized prong and the housing. This gap is optimized with other dimensions to result in wideband operation. The unbalanced coaxial transmission line meets the balun at the gap, launching the energy into the notch slot and then into free space or air. The RF signal source is typically embedded in or below the surface of a dielectric substrate and extends below the feed end of the energized prong to couple the RF signal to the notch antenna.

These notch antennas may be combined to form ultra-wideband array systems. Ultra-wideband low loss phased array systems are desired in the cellular, telemetry and military applications. Use of this technology in these areas allow greater flexibility in achieving compact low cost higher power designs.

However, since, in this type of array, the RF signal is traditionally conducted through a PCB trace, conducted power is limited.

In other words, the substrate used to hold the notch antennas, which is typically a printed circuit board, is also typically used to carry the RF signal to the notch antennas. The use of dielectric materials, such as traditional PC boards, as the substrate has certain drawbacks.

Therefore, it would be beneficial if there were a system for supporting the notch antenna elements and transmitting the requisite RF signals without being limited in its power capacity. Further, it would be advantageous if this system was also cost effective, robust and less complex to manufacture.

SUMMARY

A novel system for supporting a plurality or array of notch antenna elements is disclosed. This system allows the creation of higher power ultra-wideband step notch arrays. The system also provides electrical connection to each of the notch antenna elements via respective coaxial cables or other direct connections. These coaxial cables connect to coaxial connectors disposed on a substrate that supports the notch antenna elements. Each coaxial connector is in electrical communication with one of the notch antenna elements. By replacing the printed circuit board traditionally used with a metal substrate, higher power can be supplied to the notch antenna elements.

According to one embodiment, a notch antenna element is disclosed. The notch antenna element comprises a substrate, having first and second sides; a coaxial connector disposed on the first side of the substrate; a notch radiator element comprising an energized prong and a grounded prong separated by a slot; a base portion extending downward from the notch radiator element and defining a cavity between the notch radiator element and the substrate; and a metal housing is disposed within the cavity, comprising: a first bored portion, formed as a hollow cylinder, to mechanically attach the substrate to the grounded prong, and a second bored portion, formed as a hollow cylinder, having a coaxial transmission line center pin disposed within the hollow cylinder which electrically connects the coaxial connector to the energized prong.

In other embodiments, the notch antenna element may be fabricated in a different manner. For example, the metal housing may be integral with the notch radiator element. In other words, the components recited above may be configured in a variety of different ways to achieve the described apparatus.

BRIEF DESCRIPTION OF THE DRAWINGS

For a better understanding of the present disclosure, reference is made to the accompanying drawings, which are incorporated herein by reference and in which.

DETAILED DESCRIPTION

The present disclosure describes a notch antenna element and more specifically a novel integrated coaxial notch antenna feed used to attach the notch antenna element to a substrate and to supply higher power RF signals to the notch antenna element.

As described above, traditionally, a solid metal array similar in RF function to the metal components that form the notch antenna element above are mounted on a dielectric substrate, such as a printed circuit board. However, high power applications for ultra-wideband step notch arrays (UWSNA) have been power limited due to input feed constraints. Specifically, the power is limited by the power capabilities of the printed circuit board. To overcome this issue, the present disclosure utilizes a metal substrate to support the notch antenna elements and uses coaxial cables or coaxial connectors accepting direct connect components or PCB based backplanes to supply and/or receive the RF signals to the notch antenna elements.

While the following disclosure describes the array antenna 10 as being a transmitter of RF signals, it is understood that the array antenna 10 can also be used to receive RF signals, or to both receive and transmit.

Figure 1:
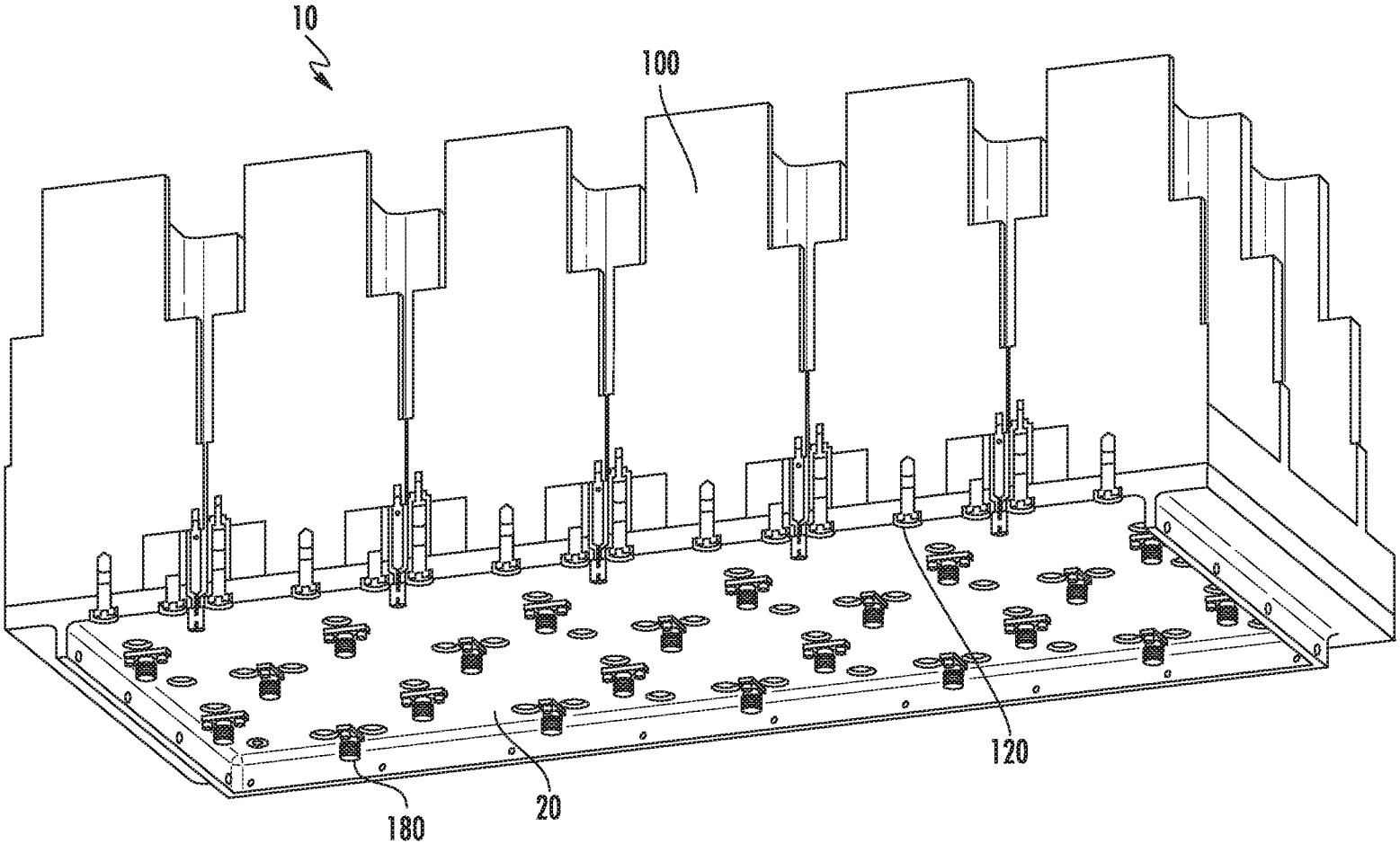
FIG. 1 shows an array antenna that utilizes the integrated coaxial notch antenna feed.

FIG. 1 shows an array antenna 10 comprising a plurality of notch antenna elements 100. The notch antenna elements 100 are attached to a substrate 20 using a plurality of fasteners 120. The substrate 20 may be any suitable material, including conductive materials or insulating materials that are coated with a conductive layer. In certain embodiments, the substrate 20 is a metal substrate, such as aluminum or copper. A plurality of holes are drilled through the substrate 20 to allow the fasteners 120 to pass through the substrate 20 and attach to the notch antenna elements 100. In the embodiments where the substrate 20 is a metal substrate, this substrate 20 also serves as the ground for the notch antenna elements 100. As will be described in more detail below, a RF signal is provided to each notch antenna element 100 using a coaxial connector 180. In operation, coaxial cables or an alternate direct connection (not shown) are connected to each of the coaxial connectors 180 to supply a RF signal to each of the plurality of notch antenna elements 100. Further, the notch antenna elements 100 are all supported by the substrate 20.

Figure 2:
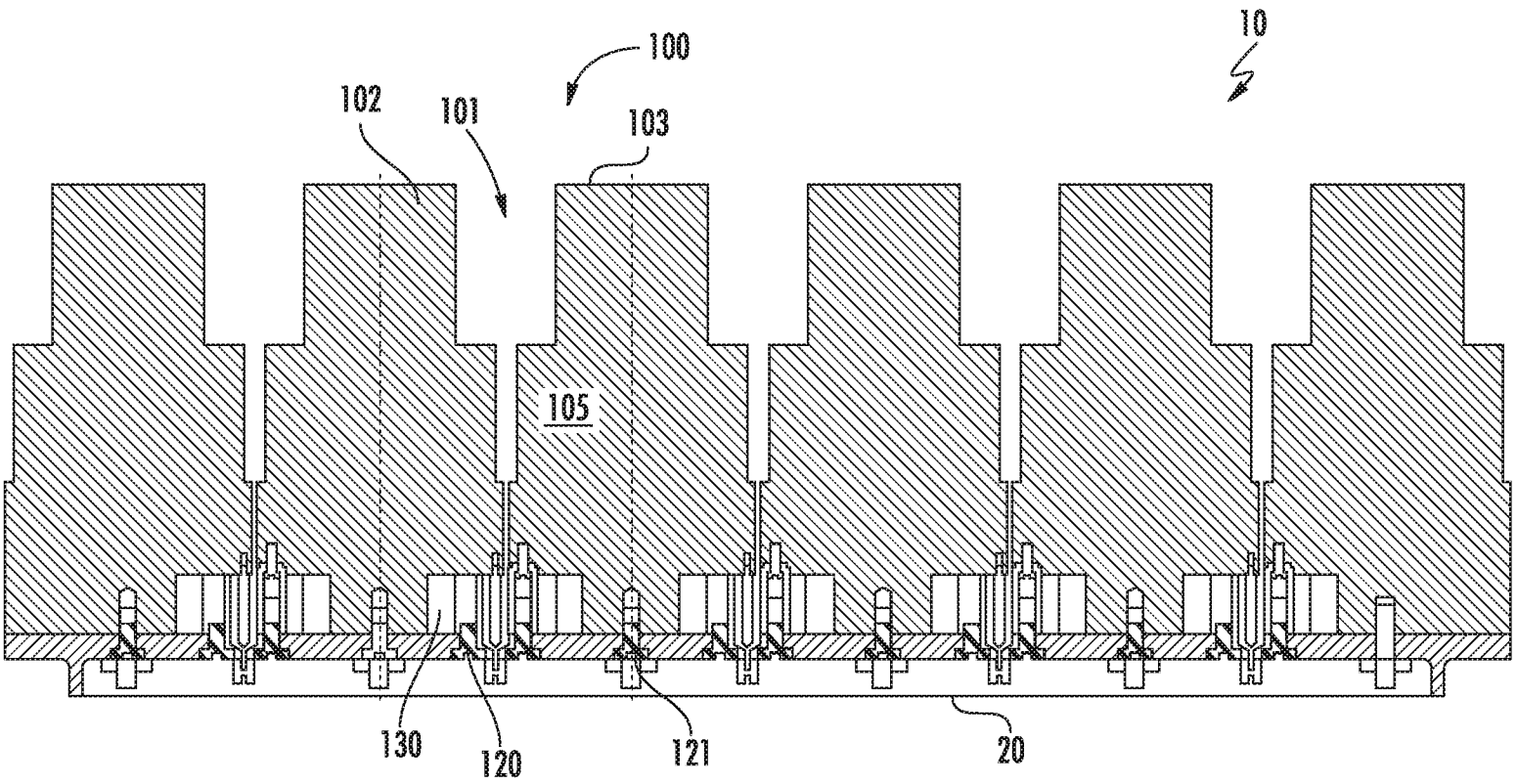
FIG. 2 shows a cross-sectional view of the array antenna of FIG. 1.

FIG. 2 shows a cross-sectional view of the array antenna 10 of FIG. 1. The dotted lines are used to delineate a single notch antenna element 100. Each notch antenna element 100 comprises a notch radiator element 105 having a slot 101 that separates the element into an energized prong 102 and a grounded prong 103. The shape of the slot 101 is not limited by this disclosure and may be as shaped in FIG. 2 or may be any other shape. For example, FIG. 2 shows the slot 101 as having three distinct steps, where the distance between the grounded prong 103 and the energized prong 102 is different for each step. However, the slot 101 may have any number of steps. Furthermore, the notch antenna element 100 may be in the shape of a horn antenna, Vivaldi or tapered slot antenna.

In addition to a slot 101, an energized prong 102 and a grounded prong 103, the notch antenna element 100 also comprises a cavity 130, also referred to as an electromagnetic cavity or EM cavity. The cavity 130 is disposed between the notch radiator element 105 and the substrate 20. Various other connections, described below, also are present.

The notch antenna element 100 is mounted to the substrate 20 using fasteners 120, 121. The fasteners 120 may be threaded and may engage with a corresponding threaded hole in the bottom side of the notch antenna element 100. Of course, in other embodiments, fasteners 120 may be replaced by welding, brazing, soldering, epoxying, studs, pinning or various bonding methods or otherwise affixed to the notch antenna element 100.

Figure 3A:
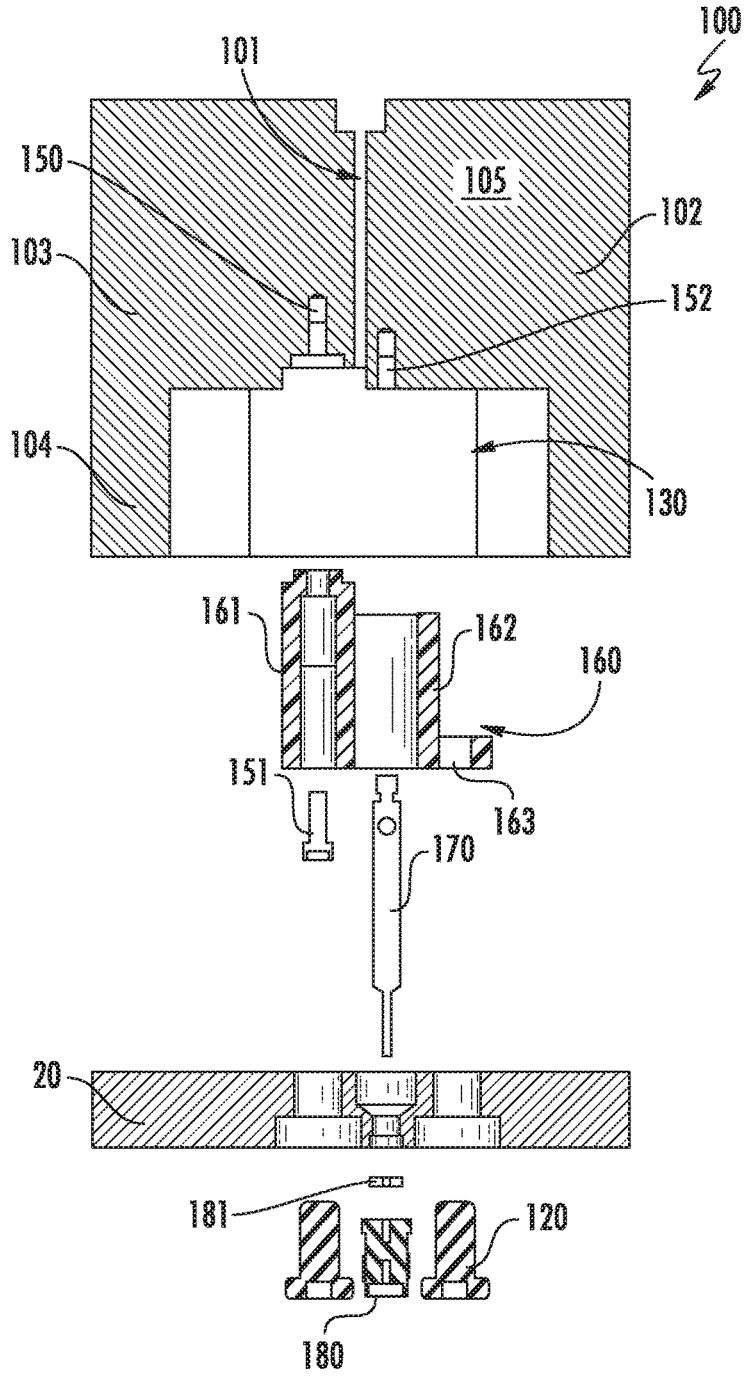
FIGS. 3A-3B show an exploded front view and an exploded perspective view, respectively, of a single notch antenna element that may be part of an array antenna.
Figure 3B:
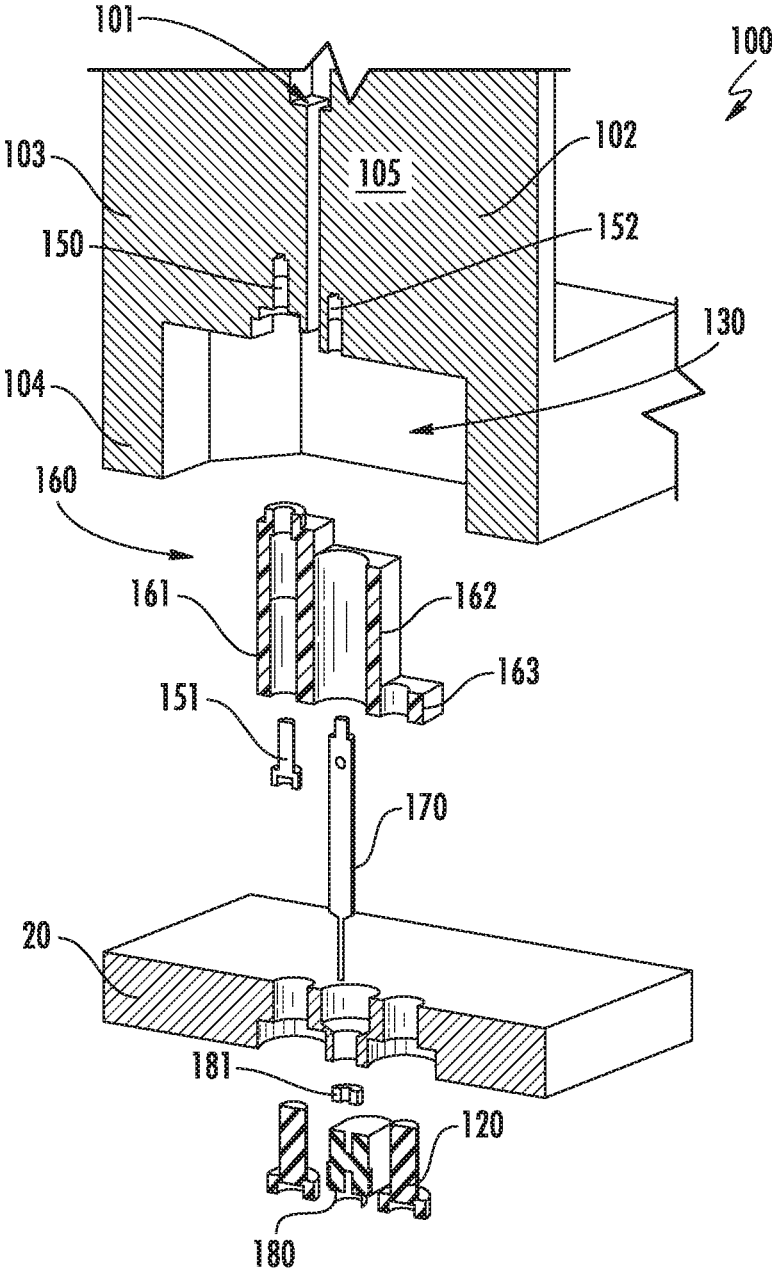

FIGS. 3A-3B shows exploded views of a notch antenna element 100. As described above, the notch antenna element 100 includes a notch radiator element 105 comprising an energized prong 102 and a grounded prong 103, separated by a slot 101. Extending downward from the notch radiator element 105 is a base portion 104. The base portion 104 is electrically connected to the notch radiator element 105. In certain embodiments, the base portion 104 may be integral with the notch radiator element 105. The base portion 104 is formed so as to create a cavity 130, disposed between the notch radiator element 105 and the substrate 20. The side of the grounded prong 103 that faces the cavity 130 may include a first threaded hole 150. Further, the base portion 104 is electrically connected to the substrate 20, such as by physical contact or by fasteners 121 (see FIG. 2).

In this embodiment, a metal housing 160 is disposed within the cavity 130 and held in place on its top side by an internal fastener 151 that is threaded into first threaded hole 150.

The metal housing 160 may have two bored portions 161, 162. The bored portions 161, 162 are each hollow, and may be configured as two hollow cylinders that are affixed to one another. The first bored portion 161 is used to house the internal fastener 151. The first bored portion 161 is open at both ends, however, the opening at the distal end nearest the grounded prong 103 is smaller than the inner diameter of the first bored portion 161. This forces the head of the internal fastener 151 to have clearance between the larger inner diameter of the first bored portion 161 while allowing clearance only for threaded portion of the internal fastener 151 at the distal end of smallest inner diameter of the first bored portion 161. The internal fastener 151 is inserted into the first bored portion 161 and secured to the first threaded hole 150. This secures the metal housing 160 in place within the cavity 130. More specifically, the top of the first bored portion 161 is in electrical contact with the grounded prong 103. In certain embodiments, this electrical contact is made by the internal fastener 151, which may be conductive. In other embodiments, the top of the first bored portion 161 physically contacts the bottom of the grounded prong 103. For example, FIG. 3A shows a recess in the bottom of the grounded prong 103 which accommodates the top of the first bored portion 161, ensuring a physical connection.

Figure 4A:
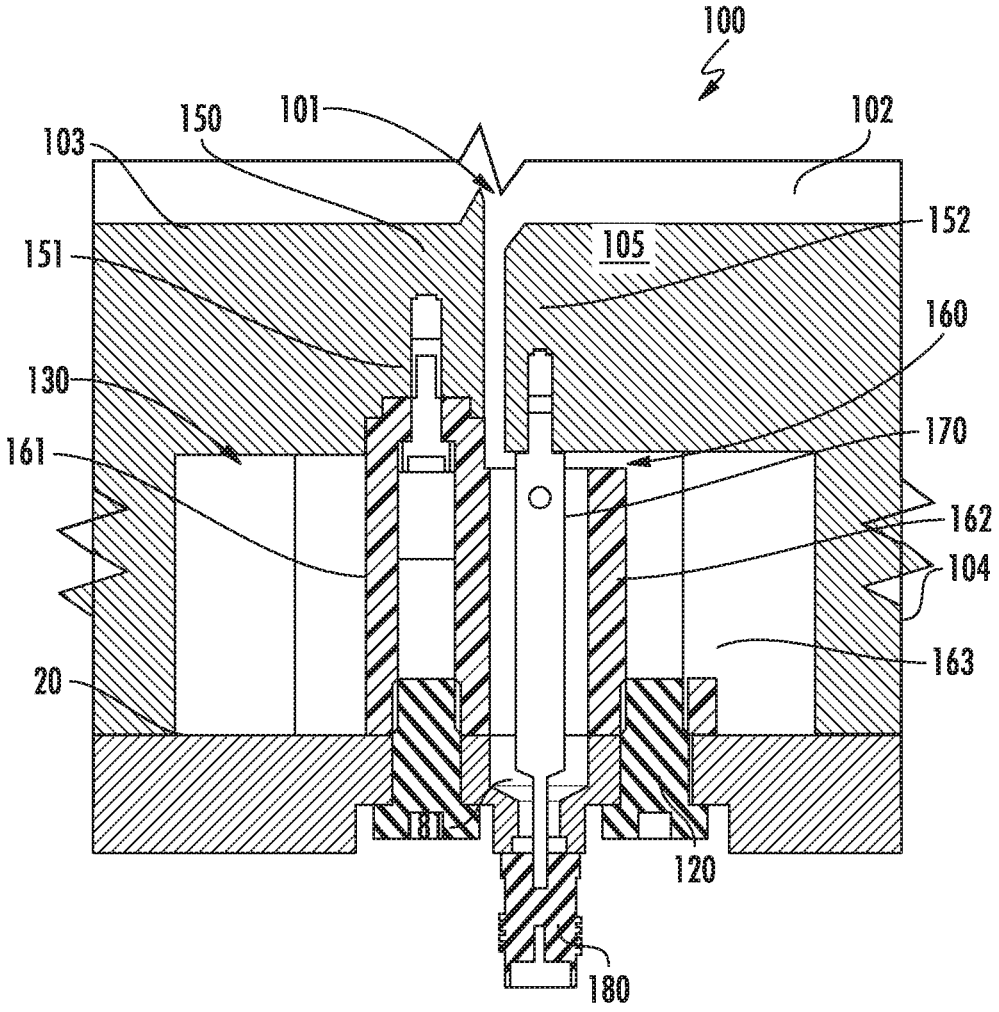
FIGS. 4A-4B show a front view and a perspective view, respectively, of the notch antenna element of FIGS. 3A-3B in its assembled form.

The second bored portion 162 is used to form an integrated air dielectric coaxial transmission line. A coaxial transmission line center pin 170 is inserted into the second bored portion 162. Unlike the first bored portion 161, the top of the second bored portion 162 may not extend to the bottom of the energized prong 102. For example, in certain embodiments, an air gap exists between the top of the second bored portion 162 and the bottom of the energized prong 102. This is best seen in FIG. 4A.

The coaxial transmission line center pin 170 is sized such that it does not contact the interior walls of the second bored portion 162. In other words, the coaxial transmission line center pin 170 is smaller in diameter than the inner diameter of the second bored portion 162. In certain embodiments, the coaxial transmission line center pin 170 is separated from the interior walls of the second bored portion 162 by air. In other embodiments, a dielectric material may be disposed around the coaxial transmission line center pin 170 to ensure that it is electrically insulated from the interior walls of the second bored portion 162, giving a higher power capability at the feed. The distal end of the coaxial transmission line center pin 170 may be inserted into a second hole 152, located in the energized prong 102. In one embodiment, the coaxial transmission line center pin 170 is threaded and is screwed into the second hole 152, which may also be threaded in this embodiment. In this particular embodiment, the coaxial transmission line center pin 170 must sit square to the metal housing 160 and energized prong 102. The machined surface at the base of the coaxial transmission line center pin 170 near the threaded portion may serve this purpose. The proper torque is applied to the coaxial transmission line center pin 170 via a torqueing hole located at the base of the coaxial transmission line center pin 170.

In another embodiment, the coaxial transmission line center pin 170 is press-fit, soldered, welded, or otherwise affixed into the second hole 152.

Note that the shape of the coaxial transmission line center pin 170 changes along its length. This may be done so that the diameter of the coaxial transmission line center pin 170 tracks the inner diameter of the second bored portion 162. Specifically, the metal housing 160 is affixed to the substrate 20 on its proximal end. The inner diameter of the opening in the substrate 20 may be tapered, as shown in FIGS. 3A-3B. The taper of the coaxial transmission line center pin 170 conforms to this variation in inner diameter. By doing this, the impedance of the coaxial transmission line center pin 170 remains constant along its length.

In certain embodiments, the diameter of the coaxial transmission line center pin 170 and/or the inner diameter of the second bored portion 162 and/or dielectric materials of various dielectric constants within the second bored portion 162 are selected to achieve a desired characteristic impedance.

As noted above, the metal housing 160 is also secured to the substrate 20. The substrate 20 also serves as the cover for the cavity 130. Holes may be drilled in the substrate 20. A fastener 120 is passed through a hole in the substrate 20 and may be affixed to the bottom end of the metal housing 160.

In one particular embodiment, the bottom end of the first bored portion 161 is threaded so that the fastener 120 can pass through the substrate 20 and be screwed into the first bored portion 161. Additionally, an extension 163 may be disposed adjacent to the second bored portion 162. The extension 163 may also be formed as a bored portion. This extension 163 may be located opposite the first bored portion 161 so as to form three cylinders arranged in a linear fashion. This extension 163 may have a threaded opening at its bottom end into which a fastener 120 may be inserted. Thus, the first bored portion 161 and the extension 163 provide two points at which the substrate 20 may be attached to the metal housing 160. This maintains the metal housing 160 in place and also insures an electrical connection between the substrate 20 and the metal housing 160.

While the above description indicated that the fasteners 120 were threaded so as to be screwed into the first bored portion 161 and the extension 163, other embodiments are also possible. For example, fasteners 120 may be replaced by welding, brazing, soldering, epoxying, studs, pinning or various bonding methods or otherwise affixed to the metal housing 160.

Finally, a coaxial connector 180 may be placed over the coaxial transmission line center pin 170. A dielectric alignment ring 181 may be inserted so as to maintain concentricity, characteristic impedance and electrical isolation between the coaxial transmission line center pin 170, the substrate 20 and the body of the coaxial connector 180.

FIGS. 3A-3B show an internal fastener 151 used to affix the first bored portion 161 of the metal housing 160 to the grounded prong 103 and a different fastener 120 used to affix the substrate 20 to the first bored portion 161. However, other embodiments are possible. For example, a single fastener, of sufficient length, may be inserted through the hole in the substrate 20, pass through the entirety of the length of the first bored portion 161 and screw into the first threaded hole 150 in the grounded prong 103.

Further, while FIGS. 3A-3B show the internal fastener 151 and the fastener 120 both disposed in the first bored portion 161, this is not required. For example, the metal housing 160 may be affixed to the grounded prong 103 in a different way. For example, the metal housing 160 may be pinned for alignment with alternate fasteners or may be press fit.

Figure 4B:
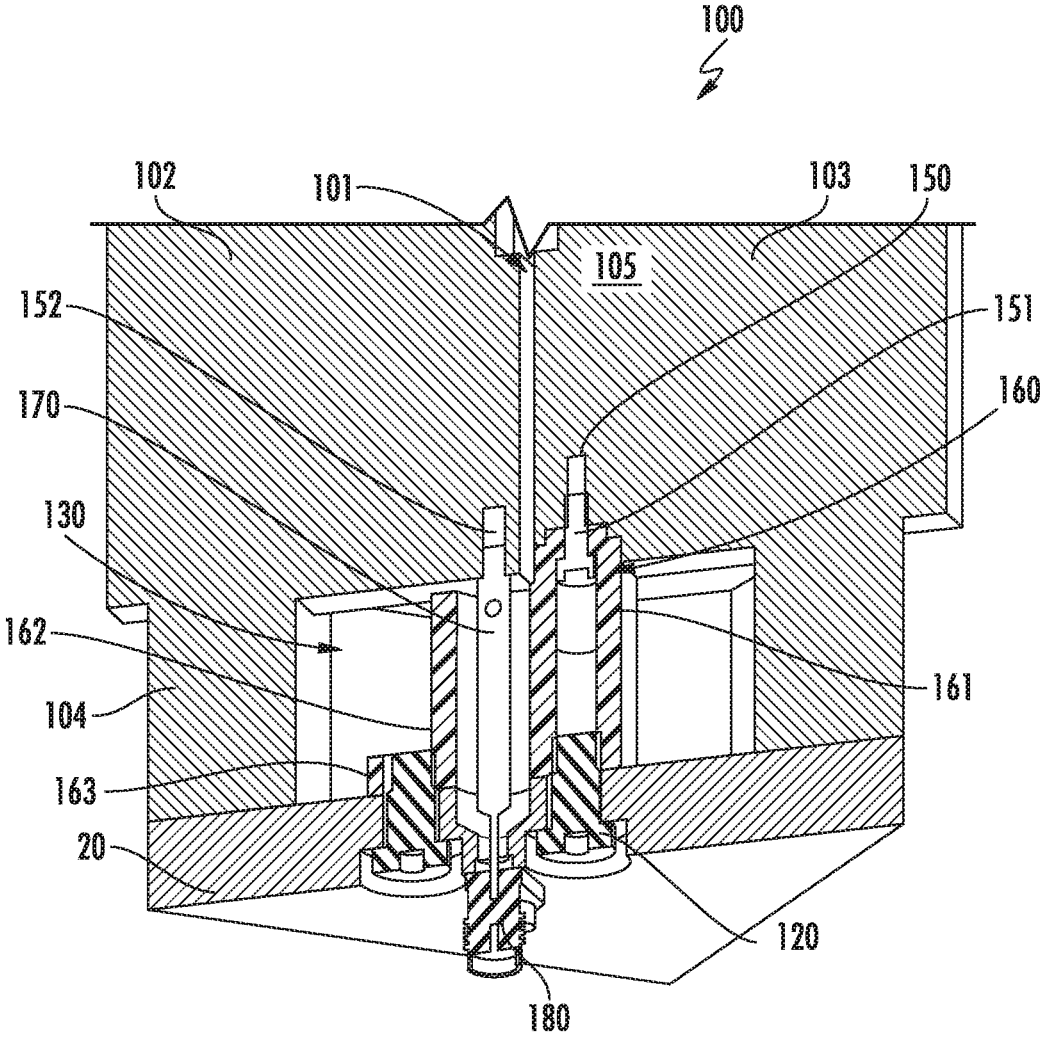

FIG. 4A shows a front view of the notch antenna element 100 in its assembled form. FIG. 4B shows a perspective view of the notch antenna element 100 in its assembled form. The internal fastener 151 serves to affix the metal housing 160 to the notch antenna element 100. The fasteners 120 serve to affix the substrate 20 to the metal housing 160. Furthermore, all of the fasteners also serve to provide the low impedance electrical conduction necessary for proper operation of the antenna. In other words, internal fastener 151 electrically connects the grounded prong 103 to the metal housing 160, while the fastener 120 electrically connects the metal housing 160 to the substrate 20. If desired, additional fasteners 121 (see FIG. 2) may be used to secure the substrate 20 to the base portion 104 of the notch antenna elements 100. Additionally, the coaxial transmission line center pin 170 extends from the substrate 20 to the energized prong 102, without contacting the metal housing 160. The placement of the coaxial transmission line center pin 170 within the second bored portion 162 of the metal housing 160 serves to extend the coaxial transmission line all the way to the energized prong 102.

FIGS. 3A-3B and 4A-4B show the notch antenna element 100 as having an energized prong 102, a grounded prong 103 and a base portion 104. A separate metal housing 160 is inserted into the cavity 130 and affixed to the notch antenna element 100 and the substrate 20. However, other embodiments are also possible.

Figure 5:
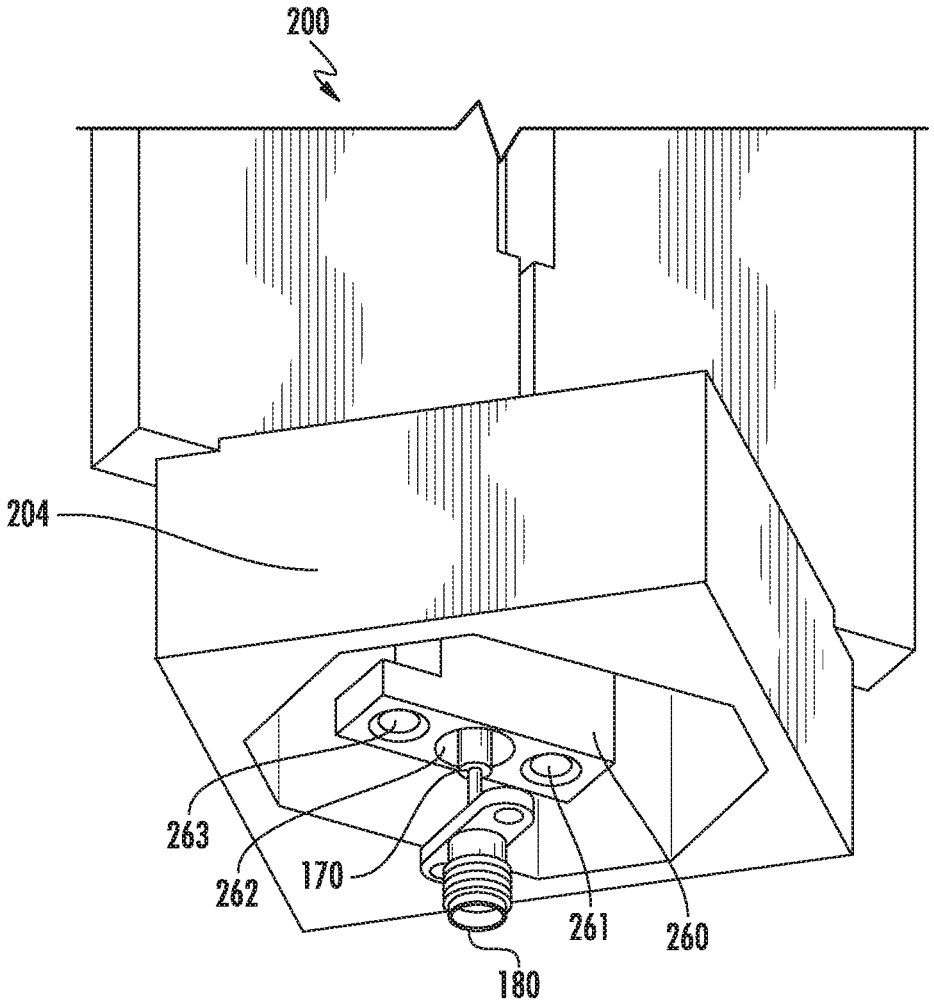
FIG. 5 shows another embodiment of the notch antenna element in which the metal housing is integral with the notch radiator element.

For example, as shown in FIG. 5, the metal housing 260 may be an integral part of the notch antenna element 200. Additionally, the base portion 204 may be a separate component. In this embodiment, the base portion 204 may be separate from the notch antenna element 200 and may be affixed to the notch antenna element 200 via screws, welding, soldering, or other means. In this embodiment, the metal housing 260 includes a first bored portion 261, a second bored portion 262 and an extension 263, as was described with respect to the previous embodiment. However, in this embodiment, since the metal housing 260 is integral with the notch antenna element 200, an internal fastener is not required. Consequently, the bore in the first bored portion 261 may not extend through the entirety of the metal housing 260. Rather, the bore in the first bored portion 261 may only be deep enough to accommodate fastener 120, used to attach the substrate to the metal housing 260. The bore in the second bored portion 262 extends to the notch antenna element 200 to accommodate the coaxial transmission line center pin 170. The substrate 20 is attached to the metal housing 260 in the same manner as was described in the previous embodiment. Similarly, the coaxial connector 180 is connected to the coaxial transmission line center pin 170 as described previously.

In other words, the fabrication and configuration of the various components is not limited by this disclosure. Rather, this disclosure describes the various components used to create the antenna array. However, the physical composition and combination of those components is not restricted to only those recited herein. For example, the metal housing 160 and the notch radiator element 105 may be an integral component, as shown in FIG. 5. Alternatively, the base portion 104 and the notch radiator element 105 may be an integral component, as shown in FIG. 2. In yet another embodiment, the metal housing 160 may be integral with the substrate 20. In another embodiment, the base portion 104 may be integral with the substrate 20.

Thus, in all embodiments, the present system includes a notch antenna element that includes a notch radiator element comprising an energized prong and a grounded prong separated by a slot. The system includes a substrate having a first and second side. The substrate is conductive. The notch antenna element is mounted to the second side of the substrate. A base portion extends downward from the notch radiator element and defines a cavity between the notch radiator element and the substrate. The cavity is defined by the base portion, the bottom surface of the notch radiator element and the substrate. A metal housing is disposed within the cavity. The metal housing includes at least a first bored portion to mechanically attach the substrate to the grounded prong, either by the use of a fastener, welding, soldering or by virtue of being integral with the notch antenna. The metal housing also includes a second bored portion to contain a coaxial transmission line center pin 170 which electrically connects the coaxial connector 180 to the energized prong. The coaxial connector is disposed on the first side of the substrate. Additional connections to the metal housing, such as using extension 163, may be added to improve the structural integrity of the assembly. A coaxial connector is then used to connect the coaxial transmission line center pin to an RF source.

Key features of the ultra-wideband step notch array described herein are the machined parts comprising the notch radiator element and all metal higher power cavity and coaxial feed. The machined cavity 130 houses the RF feed. This RF feed contains a metal housing 160 with an integrated air dielectric coaxial transmission line. The coaxial transmission line center pin threads directly into one side of the notch cavity body, aligned at the connector end with a small dielectric insert and captured at the other end by a field replaceable RF coaxial connector. The metal housing 160 is fastened in direct contact with the adjacent side of the notch cavity body leaving an EM coupled gap at the coaxial interface. An all metal cover completes the EM cavity and coaxial feed.

This new higher power design is created by replacing the PCB to metal hybrid architecture used in earlier designs with an all metal higher power cavity and coaxial feed. This new design still allows the 3-D notch array to be mounted in a tillable conformal solution, giving greater power and design flexibility with higher durability and cost effectiveness. Polarization flexibility allows single or dual polarized designs.

This design retains wide band operation while permitting higher power applications and heat exchanger capabilities. Absent of the PCB, this UWSNA permits sole source fabrication reducing time, cost and risk. Solid metal design increases durability while allowing for field repair. Array format flexibility in the terms of structure, as in a single multi-element array or many single modular unit cells used together to form a large array creation is also possible. Conformal array shaping is permissible in this machinable design architecture.

As noted above, a plurality of notch antenna elements may be used together to form a UWSNA. Referring to FIG. 2, it can be seen that, in one embodiment, the energized prong 102 of one notch antenna element may be integral with the grounded prong 103 of the adjacent notch antenna element.

Alternate materials can be used to form this array to achieve light weight applications although power limitations may be seen. As an example, this new design can be used at lower power with light weight metal plated injection molded or 3D printed plastic parts. These parts may replace or integrate in hybrid fashion with the machined metal notch antenna structure.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A notch antenna, comprising:
- a substrate, having first and second sides;
- a coaxial connector disposed on the first side of the substrate;
- a notch radiator element comprising an energized prong and a grounded prong separated by a slot, and disposed on the second side of the substrate;
- a base portion extending downward from the notch radiator element and defining a cavity between the notch radiator element and the second side of the substrate; and
- a metal housing is disposed within the cavity, comprising:
  - a first bored portion, formed as a first hollow cylinder, to mechanically attach the substrate to the grounded prong, and
  - a second bored portion, formed as a second hollow cylinder, having a coaxial transmission line center pin disposed within the second hollow cylinder which electrically connects the coaxial connector to the energized prong.

2. The notch antenna of claim 1, wherein the metal housing is separate from the notch radiator element, and an internal fastener is disposed in the first bored portion to affix the metal housing to the grounded prong.

3. The notch antenna of claim 1, wherein a fastener is disposed in a hole in the substrate and affixes the substrate to the first bored portion.

4. The notch antenna of claim 3, wherein an interior surface of the first bored portion is threaded, and the fastener comprises a screw.

5. The notch antenna of claim 1, wherein a first end of the coaxial transmission line center pin is affixed to the energized prong.

6. The notch antenna of claim 1, wherein the metal housing further comprises an extension, adjacent to the second bored portion and having a threaded opening, such that a fastener is disposed in a hole in the substrate and affixes the substrate to the threaded opening in the extension.

7. The notch antenna of claim 1, wherein the substrate comprises a metal.

8. A notch antenna element, comprising:
- a coaxial connector disposed on a first side of a substrate;
- a notch radiator element comprising an energized prong and a grounded prong separated by a slot, and disposed on the second side of the substrate;

a base portion in communication with a lower end of the notch radiator element and the substrate, and defining a cavity between the notch radiator element and a second surface of the substrate; and a metal housing is disposed within the cavity to mechanically attach the substrate to the grounded prong, and having a bored portion, formed as a hollow cylinder, having a coaxial transmission line center pin disposed within the hollow cylinder which electrically connects the coaxial connector to the energized prong.

9. The notch antenna element of claim 8, wherein the metal housing and the notch radiator element are an integral component.

10. The notch antenna element of claim 8, wherein the base portion and the notch radiator element are an integral component.

11. An antenna array, comprising:

a plurality of notch antenna elements of claim 8; and a substrate, wherein the plurality of notch antenna elements are all affixed to the substrate.

12. The antenna array of claim 11, wherein the substrate comprises a metal.

13. The antenna array of claim 11, wherein the energized prong of a first notch antenna element is integral with the grounded prong of an adjacent notch antenna element.

14. The antenna array of claim 11, wherein the metal housing is separate from the notch radiator element, and the metal housing further comprises a first bored portion, and comprising an internal fastener disposed in each respective first bored portion to affix the metal housing of each notch antenna element to the respective grounded prong.

15. The antenna array of claim 14, wherein an interior surface of each first bored portion is threaded, and the fastener comprises a screw.

16. The antenna array of claim 14, wherein each metal housing further comprises an extension, adjacent to the bored portion and having a threaded opening, such that fasteners are disposed in holes in the substrate and affix the substrate to the threaded opening in the respective extension.

17. The antenna array of claim 11, wherein a first end of each coaxial transmission line center pin is affixed to the respective energized prong.

* * * * *